US009839304B2

(12) United States Patent
Liao et al.

(10) Patent No.: US 9,839,304 B2
(45) Date of Patent: Dec. 12, 2017

(54) CONVERTIBLE BAKED GOODS DISPLAY

(71) Applicant: DEFLECTO, LLC, Indianapolis, IN (US)

(72) Inventors: Joe Liao, Foshan (CN); Danielle N. Rodgers, Indianapolis, IN (US); Patrick Foley, Fishers, IN (US)

(73) Assignee: Deflecto, LLC, Indianapolis, IN (US)

( * ) Notice: Subject to any disclaimer, the term of this patent is extended or adjusted under 35 U.S.C. 154(b) by 0 days.

(21) Appl. No.: 14/986,908

(22) Filed: Jan. 4, 2016

(65) Prior Publication Data

US 2016/0192789 A1 Jul. 7, 2016

Related U.S. Application Data

(60) Provisional application No. 62/099,865, filed on Jan. 5, 2015.

(51) Int. Cl.

| | |
|---|---|
| ***A47F 7/00*** | (2006.01) |
| ***A47F 5/00*** | (2006.01) |
| ***A47F 5/04*** | (2006.01) |
| ***A47F 5/10*** | (2006.01) |
| ***A47C 19/00*** | (2006.01) |

(52) U.S. Cl.

CPC ..... *A47F 5/0018* (2013.01); *A47C 19/00* (2013.01); *A47F 5/04* (2013.01); *A47F 5/10* (2013.01); *A47B 2230/0092* (2013.01)

(58) Field of Classification Search

CPC .... A47F 7/0071; A47F 5/0018; A47F 5/0043; A47F 5/04; A47F 5/10; A47G 19/00; A47B 2230/0092

USPC ..... 211/128.1, 129.1, 130.1, 133.4, 126.16, 211/135

See application file for complete search history.

(56) References Cited

U.S. PATENT DOCUMENTS 1,047,882 A * 12/1912 Beach ..... A47F 5/10 108/101
1,600,813 A * 9/1926 Flentye ..... A47G 33/06 428/19
1,881,423 A * 10/1932 Favreau ..... A47G 33/06 428/19

(Continued)

FOREIGN PATENT DOCUMENTS

CA 2321340 A1 * 3/2002 ..... A47F 5/0043

OTHER PUBLICATIONS

Cupcake Stand. Exclusively Weddings YouTube Account. Oct. 17, 2013 (Oct. 17, 2013) [online], [retrieved on Feb. 23, 2016]. Retrieved from the internet: CURL: https://www.youtube.com/watch?v=rNfP8pAGbtw> Entire document, especially 0:18-0:50.

(Continued)

*Primary Examiner* — Stanton L Krycinski
(74) *Attorney, Agent, or Firm* — Dentons US LLP; Brian R. McGinley; Roman Tsibulevskiy

(57) ABSTRACT

A display system that includes a vertical trunk with a first support including a first slot in a lower portion of the first support, and a second support including a second slot in an upper portion of the second support and at least one platform having an upper surface facing a lower surface, where the platform including a first groove and a second groove are configured to connect the platform to the vertical trunk and disconnect the platform from the vertical trunk.

14 Claims, 10 Drawing Sheets

(56) References Cited

U.S. PATENT DOCUMENTS 2,188,081 A * 1/1940 Guthrie ..... A47G 33/06 428/12
2,359,559 A * 10/1944 Horky ..... A47G 33/06 362/565
2,526,246 A * 10/1950 Leeper ..... A47F 5/10 108/101
2,865,122 A * 12/1958 Clawson ..... A47F 5/02 211/50
2,916,843 A * 12/1959 Meyer ..... A47G 33/06 40/124.4
3,338,189 A 8/1967 Xavier
3,797,149 A * 3/1974 Morrison ..... G09F 1/14 40/124.2
4,026,220 A 5/1977 Schuring, Jr.
4,196,239 A * 4/1980 Sawyer ..... A41G 1/00 156/61
4,315,376 A * 2/1982 Eichenauer ..... G09F 1/14 40/124.19
4,338,866 A 7/1982 Streit
4,746,022 A * 5/1988 Benham ..... A47F 5/04 211/195
D313,772 S * 1/1991 Beauregard ..... D11/118
5,042,760 A * 8/1991 Boschetto ..... A47F 7/143 248/152
5,094,348 A * 3/1992 Harris ..... A47B 87/00 211/194
D354,928 S * 1/1995 Hoffman ..... D11/118
D357,432 S * 4/1995 Snodgrass ..... D11/118
5,413,801 A * 5/1995 McIlwain ..... A23G 3/50 211/126.2
5,603,175 A * 2/1997 Brenner ..... G09F 1/10 40/124.4
D379,941 S * 6/1997 Scott ..... D11/118
5,894,052 A * 4/1999 Sawyer ..... A41G 1/001 428/15
5,911,328 A * 6/1999 Shampo ..... A47F 5/04 211/40
6,736,632 B2 * 5/2004 Wolter ..... A47G 19/00 431/253
6,918,497 B2 * 7/2005 Davis ..... A47B 47/00 211/183
7,021,465 B1 * 4/2006 McGuigan ..... A47G 19/00 206/457
D527,302 S * 8/2006 Vladamirov ..... D11/121
7,178,804 B1 * 2/2007 Traylor ..... A63F 3/00697 273/288
8,967,399 B2 * 3/2015 Hawkins ..... A47F 5/10 211/126.2
9,084,497 B2 * 7/2015 Hawkins ..... A47F 3/142
2003/0226782 A1 * 12/2003 Loughlin ..... A47F 7/0028 206/564
2007/0023607 A1 2/2007 Franczyk
2008/0271483 A1 * 11/2008 Horkey ..... A47F 5/04 63/23
2009/0063166 A1 * 3/2009 Palmer ..... A47F 5/06 705/5
2009/0211124 A1 * 8/2009 Horkey ..... A47F 5/04 40/1
2011/0303131 A1 * 12/2011 Goode ..... A47G 19/00 108/101
2013/0136829 A1 * 5/2013 Kandel ..... A47G 19/00 426/132

OTHER PUBLICATIONS

How to build Original Cupcaketree Cupcake Stands for your wedding. Cupcaketree Cupcake Stands. Oct. 20, 2011 (Oct. 20, 2011) [online], [retrieved on Feb. 25, 2016). Retrieved from the internet: <URL: https://www.youtube.com/watch?v=jTQ3LtEpdSg> Entire document, especially 0:32-0:33, 0:34-0:40, 0:42-1:08, 1:32, 2:39.

Cake Pops 101: Tips, Tricks & Great Ideas on How to Display Your Cake Pops!: Niner Bakes. Jan. 22, 2013 (Jan. 22, 2013) [online], [retrieved on Feb. 24, 2016]. Retrieved from the Internet: <URL:http://www.ninerbakes.com/2013/01/22/cakepops-101-ideas-how-to-display-cake-pops-guide-help/> Entire document, especially Fig. 2 and Fig. 3.

3 tier silver cardboard cupcake stand Kindvast. May 23, 2012 (May 23, 2012) [online], [retrieved on Mar. 2, 2016]. Retrieved from the internet: <URL: http://sell.lulusoso.com/selling- leads/1871392/3-tier-silver-cardboard-cupcake-stand.html> Entire document, especially Fig. 1.

* cited by examiner

CONVERTIBLE BAKED GOODS DISPLAY

RELATED APPLICATION DATA

The present application claims priority to U.S. provisional application 62/099,865 filed in the United States Patent Office on Jan. 5, 2015, the entirety of which is hereby incorporated by reference to the extent permitted by law.

FIELD OF THE INVENTION

The present invention relates to a stand for holding and displaying a food item such as cupcakes, cake pops, cookies or any combinations thereof, and generally includes a vertical trunk having a plurality of platforms detachably connected to the vertical trunk.

BACKGROUND OF THE INVENTION

Many display stands for holding and displaying food items have a design that is limited to one set configuration which often limits the display stand to one particular food item. These display stands are not customizable and cannot be adjusted or configured to display different food items, especially when the food items have varying heights or different support needs. Accordingly, there is a need for a stand that can easily be used to display different food items, either separately or at the same time.

SUMMARY OF THE INVENTION

An object of one embodiment of the invention includes a vertical trunk comprising (a) a first support including a first slot in a lower portion of the first support, and (b) a second support including a second slot in an upper portion of the second support and at least one platform comprising an upper surface facing a lower surface, the platform including a first groove and a second groove configured to connect the platform to the vertical trunk and disconnect the platform from the vertical trunk. In this embodiment, the first and second supports are oriented such that first slot and the second slot align with respect to each other and engage to form a vertical trunk. Further, the first and second supports can both engage and disengage from each other.

In another embodiment of the invention, the platform can be slidably inserted onto the trunk. Further, the platform can include an opening configured to receive an item therein on the upper surface.

In another embodiment of the invention, the first and second slots engage with each other to form an x-shaped base.

In another embodiment of the invention the first and second support each have a pair of mounts located at a point along the longitudinal axis of the support, each mount is of a shape and dimension sufficient to receive at least a portion of one of the grooves within the platform. The mounts can also include a securing mechanism.

In another embodiment of the invention the first and second grooves on the platform have the same corresponding dimensions so as to form a first x-shaped pair that can be conceived to rotate uniformly about a longitudinal axis.

In another embodiment of the invention, the platform includes a third groove and a fourth groove which have the same corresponding dimensions so as to form a second x-shaped pair that can be conceived to rotate uniformly about the longitudinal axis.

In another embodiment of the invention, the first pair of grooves is configured such that one or more of its depth, length, and width differ from one or more of the depth, length and width of the second pair of grooves.

In another embodiment of the invention, the location where the platform is attached to the vertical trunk can be changed by rotating the platform such that the first pair of grooves or the second pair of grooves align with the mounts on the vertical trunk.

Another embodiment of the invention includes a kit that includes a first support including a first slot in a lower portion of the first support, a second support including a second slot in an upper portion of the second support, and at least one platform comprising an upper surface facing a lower surface, the platform including a first groove and a second groove. In this embodiment, the first and second supports are oriented such that first slot and the second slot align with respect to each other to engage and disengage with each other.

In another embodiment of the invention, there is a method for of displaying items comprising the steps of providing a first support including a first slot in a lower portion of the first support, providing a second support including a second slot in an upper portion of the second support, orienting the first slot and the second slot to align with respect to each other to engage and form a vertical trunk and providing at least one platform comprising (a) an upper surface facing a lower surface, and (b) a first groove and a second groove each configured to connect the platform to the vertical trunk and disconnect the platform from the vertical trunk and connecting the platform to the vertical trunk. Further, the first and second support can disengage from each other to form separate parts.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE INVENTION

Figure 1:
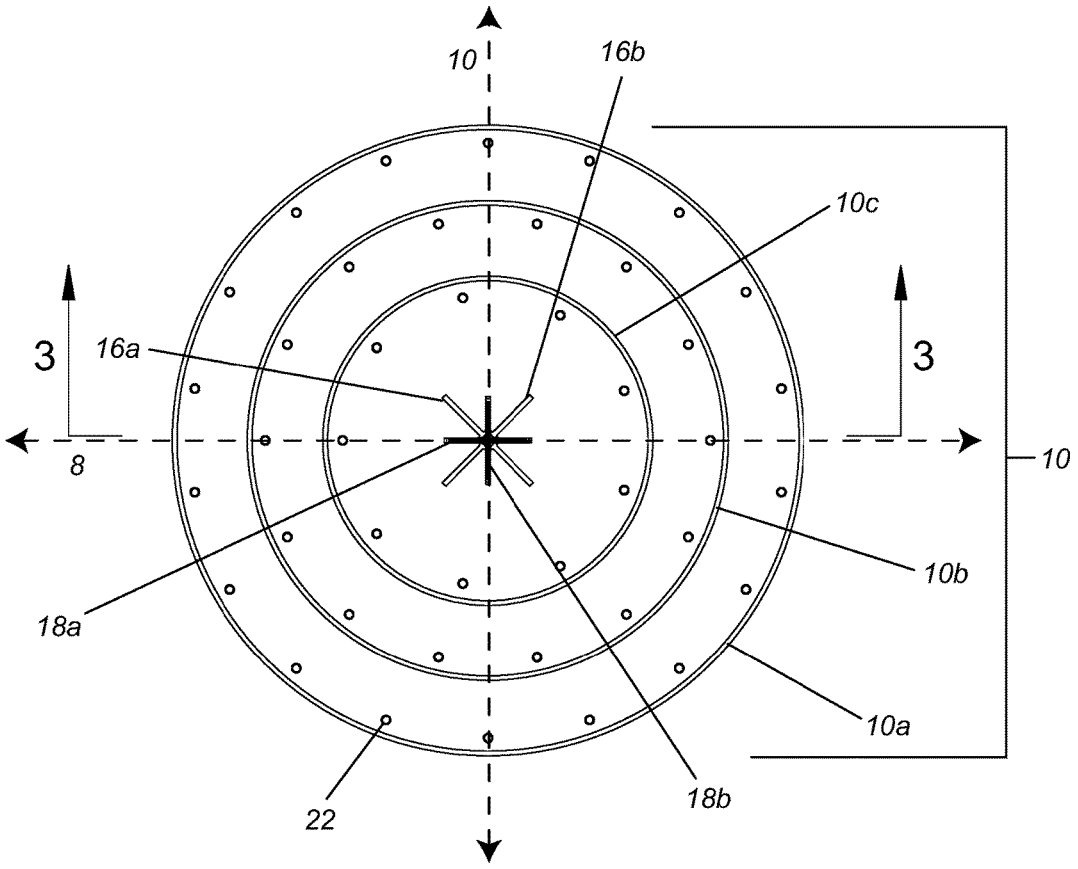
FIG. 1 depicts a top view perspective of the display in an embodiment of the invention.

FIG. 1 shows a top view of a display according to an embodiment of the invention. The display may include a platform 10 or plurality of platforms 10*a*, 10*b* and 10*c*, each of which can vary in shape and or size and each of which have an upper surface facing a lower surface. The display can include any number of platforms as desired by a user. In an embodiment, each platform includes at least one groove or channel 16*a*, 16*b*, 18*a*, and/or 18*b* configured to connect the platform in a secure and stable manner to the vertical trunk 20 (not shown in this view) and disconnect the platform from the vertical trunk.

Planes that bisect the platform may intersect to define a horizontal axis 8 and a longitudinal axis 10 about which the grooves can be spaced such that the platform may be conceived to rotate uniformly about the longitudinal axis 10. The grooves can be configured such that one or more of its corresponding dimensions, such as its depth, length, and/or width differ from the dimensions of one or more of the other grooves on the platform. In one embodiment of the invention, two grooves can be configured to have the same corresponding dimensions so as to form an x-shaped pair that can be conceived to rotate uniformly about a longitudinal axis 10. The platform 10 can be removably attached to the vertical trunk by aligning one or more grooves with a mount or mounts on the vertical trunk. In some embodiments, the grooves can also be configured to have a predetermined length that coordinates with a mount or mounts on the vertical trunk. The location where the platform is attached to the vertical trunk can be changed by rotating the platform 12 to vary the groove or grooves that align with the mount or mounts on the vertical trunk. Once the groove or grooves are aligned with the mount or mounts the platform can be maneuvered into place. In an embodiment a user can slide the platform down the trunk to the mount or mounts and engage the groove or grooves with the corresponding mount or mounts.

Figure 4:
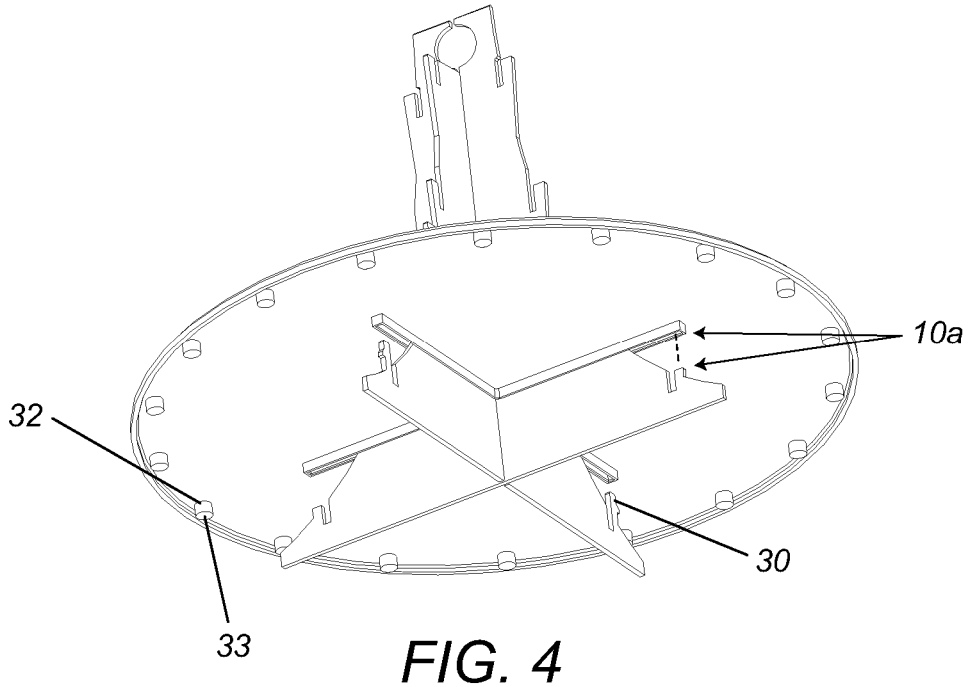
FIG. 4 depicts a view of the base of the vertical trunk with an unengaged platform.

One or more of the platforms can also include an opening 22 or a plurality of openings 22 of a sufficient size to receive a straw or stick commonly used with food items such as a cake pop, lollipop or the like. Each opening is further configured to support the straw or stick when the straw or stick is inserted into the opening 22. In an embodiment the straw or stick can be supported in the opening by frictionally engaging with interior perimeter of the opening. As shown in FIG. 4 the opening can have a receptacle 32 with an end cap 33 that may serve as a base to support a straw or stick inserted in an opening. The opening 22 and the receptacle 32 are not limited in shape, size, location or number. To best display items of varying shapes, a cross section through the longitudinal axis of the receptacle may define different perimeters such as triangle perimeter, oval perimeter, rectangular perimeter, circular perimeter or the like. In the case of displaying a cake pop, the opening and receptacle would have a circular perimeter of and an area sufficient to display and support standard sized cake pop sticks 54. Additionally, the openings can circumscribe the perimeter of a platform, create a design on the platform, create concentric shapes that circumscribe the perimeter of a platform or be randomly placed on the platform.

Figure 2:
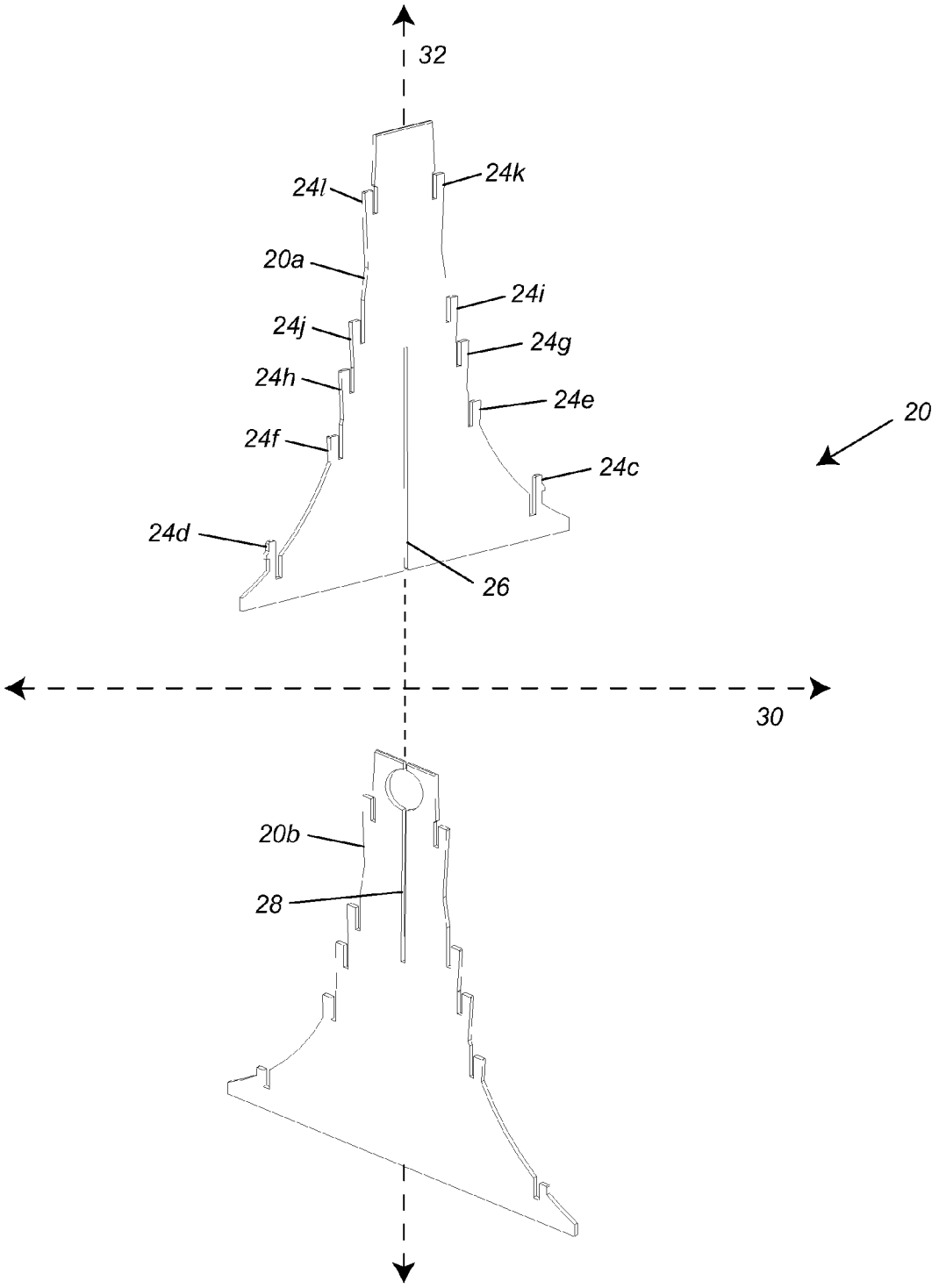
FIG. 2 depicts an exploded view of an embodiment of the vertical trunk.

FIG. 2 is an exploded view of an embodiment of the vertical trunk 20 that includes a first support 20*a* and second support 20*b*. Planes that bisect each support may intersect to define a horizontal axis 30 and a longitudinal axis 32 about which each support may be conceived to rotate uniformly about the longitudinal axis 32.

The first support 20*a* includes a narrow opening or slot 26 in a portion of the first support that is on the longitudinal axis or parallel to the longitudinal axis in a portion. The second support has a narrow opening or slot 28 in a portion of the second support 20*b* that is on the longitudinal axis or parallel to the longitudinal axis that corresponds to the slot 26 on the first support. When assembled, the first and second supports are oriented such that first slot 26 and the second slot 28 align with respect to each other and engage to form a vertical trunk 20 with an x-shaped base. The construction of the supports may be such that the supports can be easily connected and disconnected in order to allow for a display that can be easily assembled or disassembled for compact storage.

Further, as shown in FIG. 2, each support may have one or more mounts 24*c*; 24*d*; 24*e*; 24*f*; 24*g*; 24*h*; 24*i*; 24*j*; 24*k* & 24*l* located at different positions along the longitudinal axis of the support. Each mount is of a shape and dimension sufficient to receive at least a portion of one groove in the platform. A support can include two mounts 24*c* and 24*d* that face each other to form a pair. The support can include one or more pairs of mounts, as shown by 24*e* & 24*f*; 24*g* & 24*h*; 24*i* & 24*j* and 24*k* & 24*l*.

Figure 3:
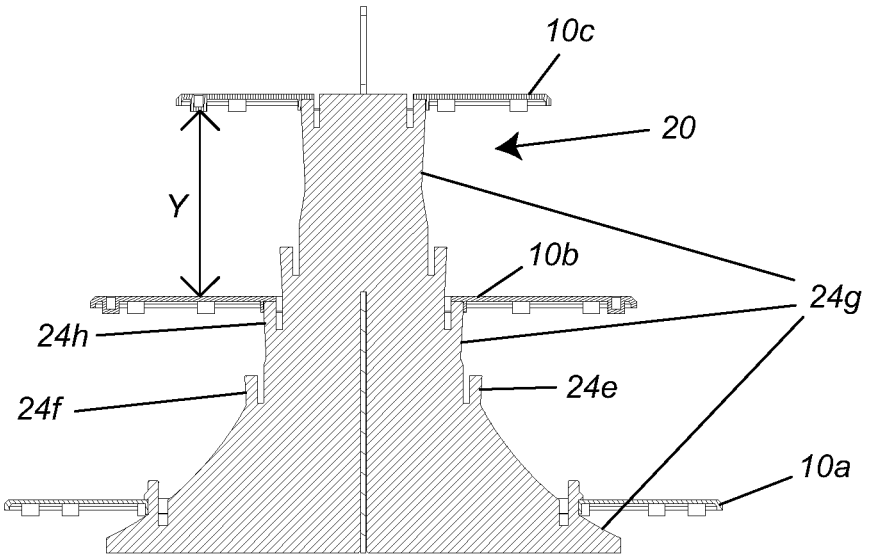
FIG. 3 depicts a profile perspective of the display according to an embodiment of the invention.

As shown in FIG. 3, when a groove, grooves or pair of grooves are aligned over a corresponding mount or mounts 24, the platform can removably connect to the vertical trunk. Additionally, the platform can be placed at different locations on the vertical trunk by selecting to align a specific groove, grooves or pair of grooves with the corresponding mount or mounts. For example, in an embodiment shown in FIG. 3 the platform can be rotated such that grooves 18 align with mounts 24*e* and 24*f* or 24*i* and 24*j*. Based on the position that the platform is placed the vertical distance, y, between one or more platforms can be increased or decreased to accommodate different sized baked items.

FIG. 4 shows a securing mechanism 30 on the mount, which can be used to provide additional security and rigidity when the platform is connected to the vertical trunk. In this embodiment, the securing mechanism is a tab integrally molded as part of the support. The tab has sufficient flexibility to enable the tab to clear the edge of the groove of a platform allowing the platform to snap into place. The securing mechanism can also take the form of a slide-on clip with a projecting top design having an interlocking edge that is received within the groove of the platform. The groove may have a small ledge around all or a portion of its periphery to cause the securing mechanism to slide into place therein. Clips, snap-on clips and other securing mechanisms known to those of ordinary skill in the art can also be used to connect and disconnect the platform to the vertical trunk.

Figure 5:
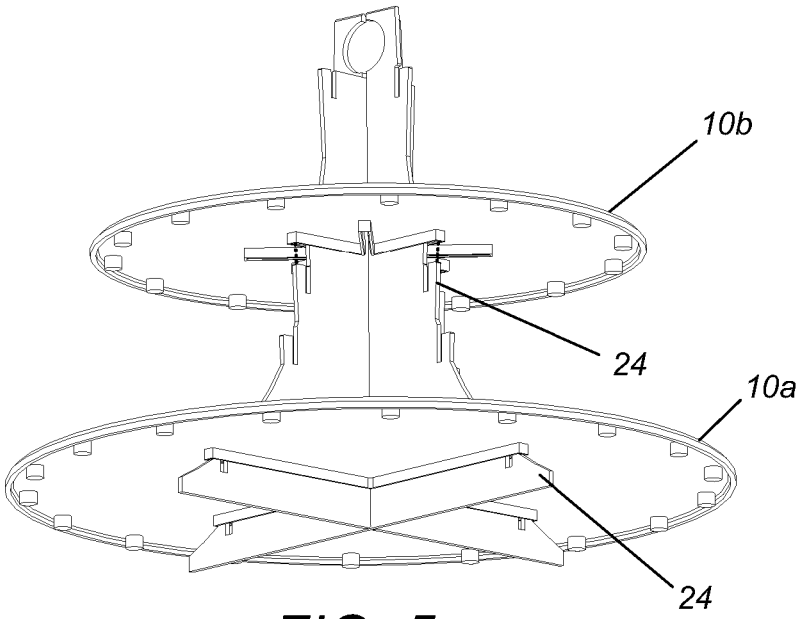
FIG. 5 depicts a view of the display according to an embodiment of the invention.

FIG. 5 shows an embodiment of the invention where the platform 10*b* is aligned over a securing mechanism 30 prior to engaging the platform with the mount. Platform 10*a* shows the platform which is connected to the vertical trunk 20 via one or more mounts. The construction of the vertical trunk and the platforms is such that they can be easily connected and disconnected in order to allow for a display with adjustable vertical distances between platforms and that can also be easily assembled or disassembled for compact storage.

Figure 6:
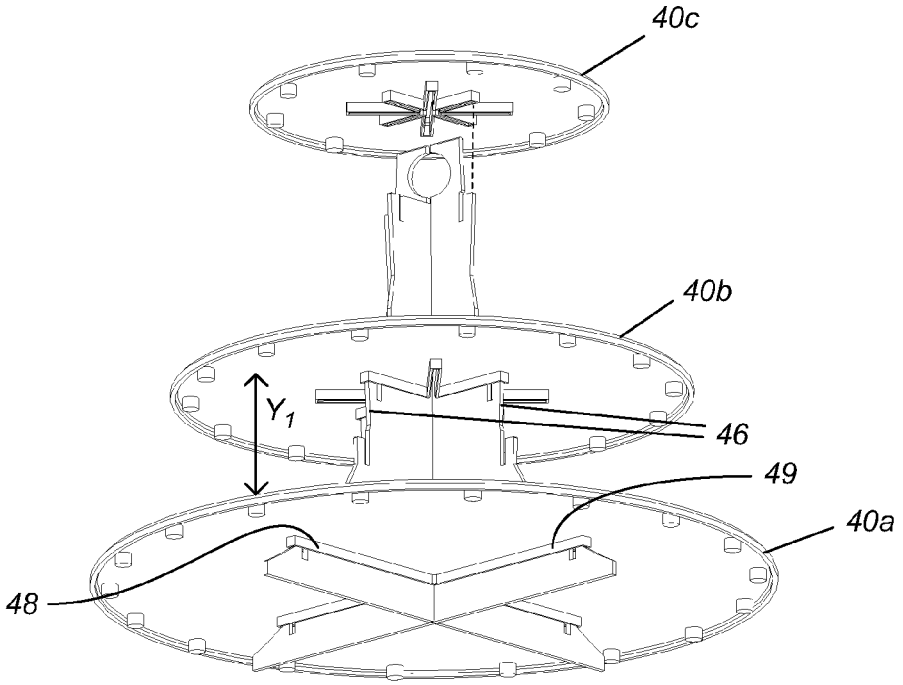
FIG. 6 depicts a view of the display according to an embodiment of the invention.
Figure 8:
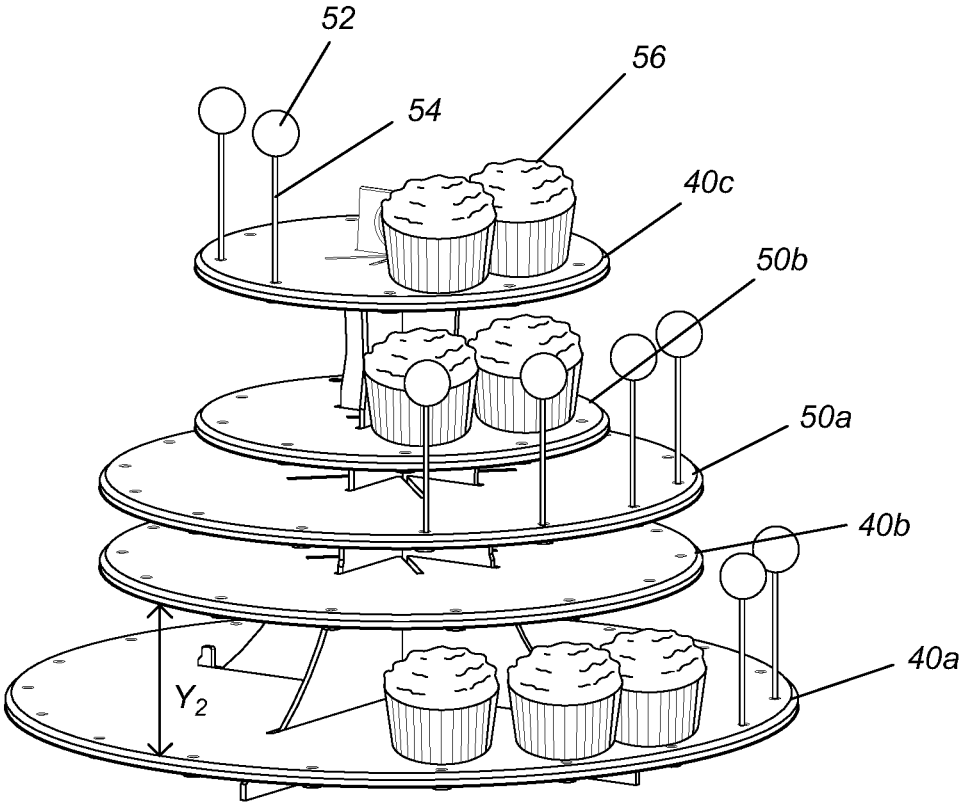
FIG. 8 depicts a view of the display according to an embodiment of the invention.

FIG. 6 shows an embodiment of the invention where two platforms are connected to the vertical trunk. As shown in this figure, platform 40*b* is connected to the vertical trunk using mounts 46 thereby setting the vertical distance between platform 40*b* and platform 40*a* to a distance $y_1$. The platform is connected to the vertical trunk via the mounts 46 by rotating the platform such the pair of grooves align with the mounts 46. As shown in FIG. 8, the platform 40*b* can be rotated such that a different pair of grooves on the platform align with a lower pair of mounts thereby reducing the vertical distance $y_2$ between platforms 40*b* and 40*a*.

The grooves may also have projecting edges 48 and 49 whose perimeter defines a cavity that circumscribes the perimeter of the groove. The cavity can provide additional support and stability for the platform when it is connected to the vertical trunk. Additionally, the cavity may serve as a guide to help align the groove, grooves or pair of grooves with the corresponding mount, mounts or pair of mounts on the vertical trunk.

Figure 7:
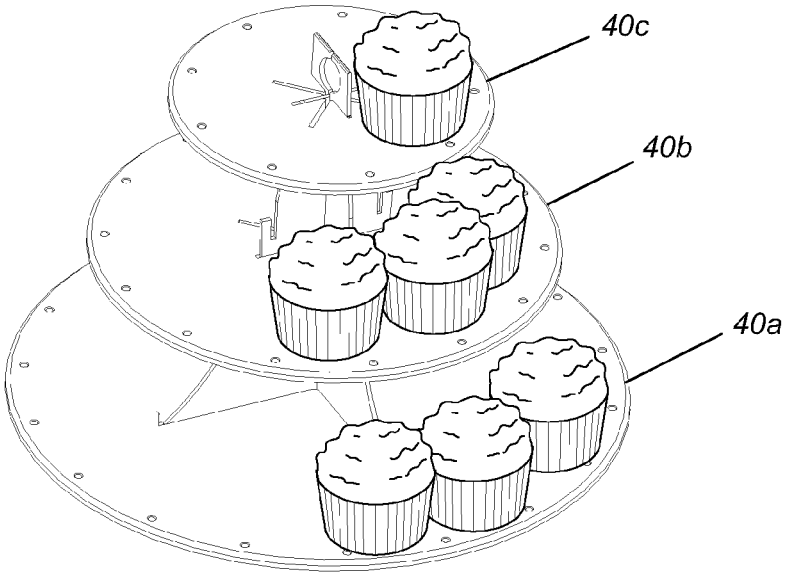
FIG. 7 depicts a view of the display according to an embodiment of the invention.

FIGS. 7 and 8 show embodiments of the invention where the display stand is customized to accommodate different baked goods and varying amounts of baked goods by changing the heights between the platforms and the number of platforms connected to the vertical trunk. For example, in FIGS. 7 and 8, the distances between the platforms and the number of platforms connected to the vertical trunk are changed allowing a user to display different types of baked goods by varying platform positions on the vertical trunk. Specifically, the platforms can be adjusted so that the height $y_2$ between platforms 40*a* and 40*b* can be decreased to accommodate a shorter baked good item such as a cupcake or cookie. Additionally, as shown in FIG. 8, additional platforms 50*a* and 50*b* can be added to the trunk to increase the display area, allowing for more items to be displayed. Additionally, the diameter of the platforms can vary. For example, platform 50*b* is smaller than the platform 50*a*. In an embodiment, the platform can have a diameter of 12 inches, 8 inches, 6 inches, 3 inches or 2 inches. As shown in FIG. 8, the platforms 50*a* and 50*b* can be arranged in order to accommodate taller baked good items around the periphery of the lower platform 50*a*. In an embodiment this can be accomplished by increasing the height between the platforms. In another embodiment this can be accomplished by adjusting the size of the platform itself. For example, in FIG. 8 using platform 50*b*, which has a smaller circumference than platform 50*a* allows for taller items to be displayed on the periphery of platform 50*a*.

The height between platforms can be adjusted as shown with y.sub.2 to accommodate only one sized baked good according to its height. For example, the height between platforms can be increased to display taller baked good items, like a cake pop 52 or lollipop or the height can be decreased to accommodate and display a smaller baked good item like a cupcake 56.

Figure 9:
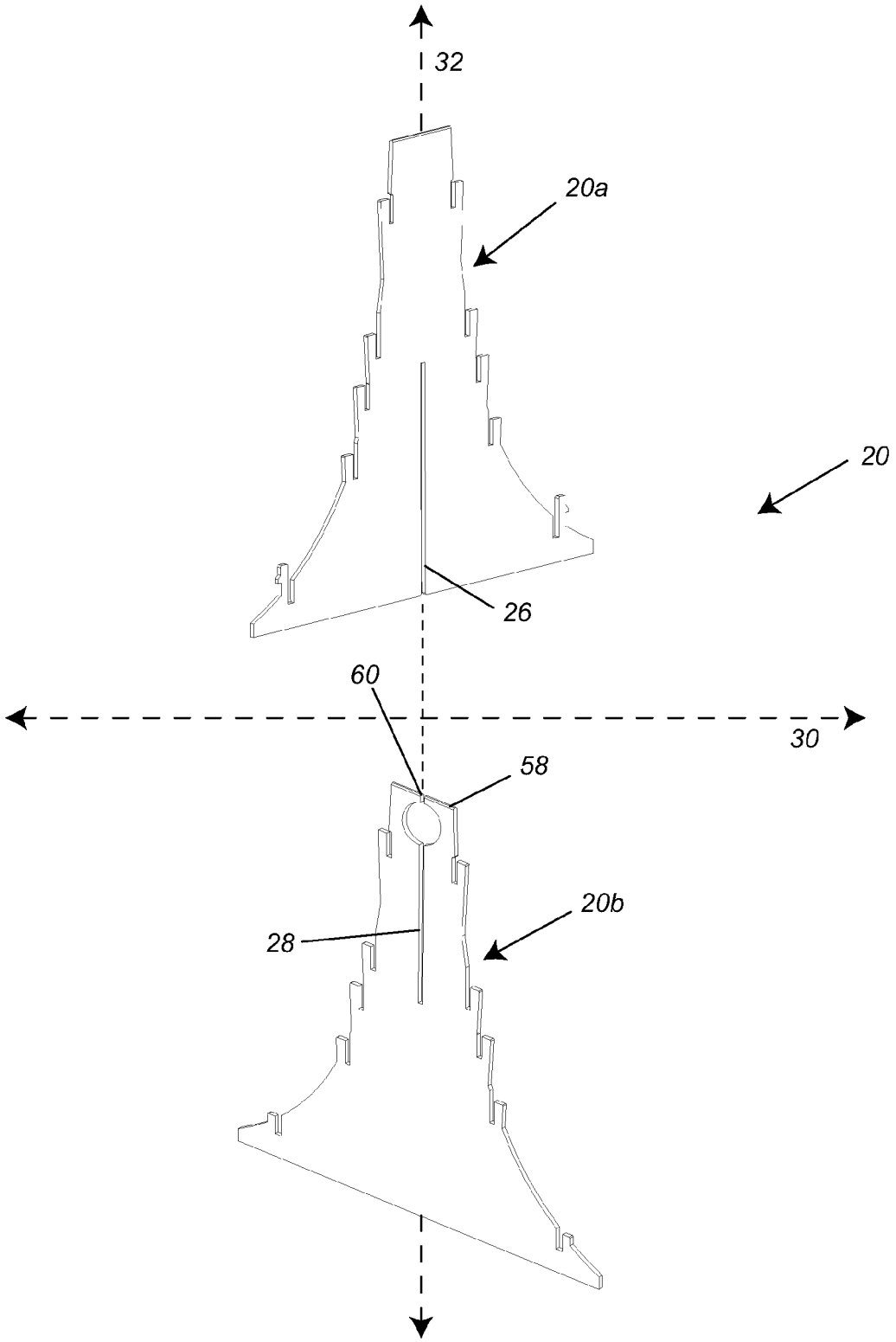
FIG. 9 depicts a view of the vertical trunk according to an embodiment of the invention.

FIG. 9 is an exploded view of an embodiment of the vertical trunk 20 that includes a first and second support 20*a* and 20*b*. Planes that bisect each support may intersect to define a horizontal axis 30 and a longitudinal axis 32 about which each support may be conceived to rotate uniformly about the longitudinal axis 32.

In this embodiment, the second support includes a handle 58 configured to allow a user to grasp the handle and transport the vertical trunk from one location to another. The handle has a narrow opening or a third slot 60 in a portion of the handle 58 that is on the longitudinal axis or parallel to the longitudinal axis that corresponds to the slot 26 on the first support. When assembled, the first and second supports are oriented such that first slot 26, the second slot 28 and the third slot 60 align with respect to each other and engage to form a vertical trunk 20 with an x-shaped base. The construction of the supports may be such that the supports can be easily connected and disconnected in order to allow for a display that can be easily assembled or disassembled for compact storage.

Figure 10:
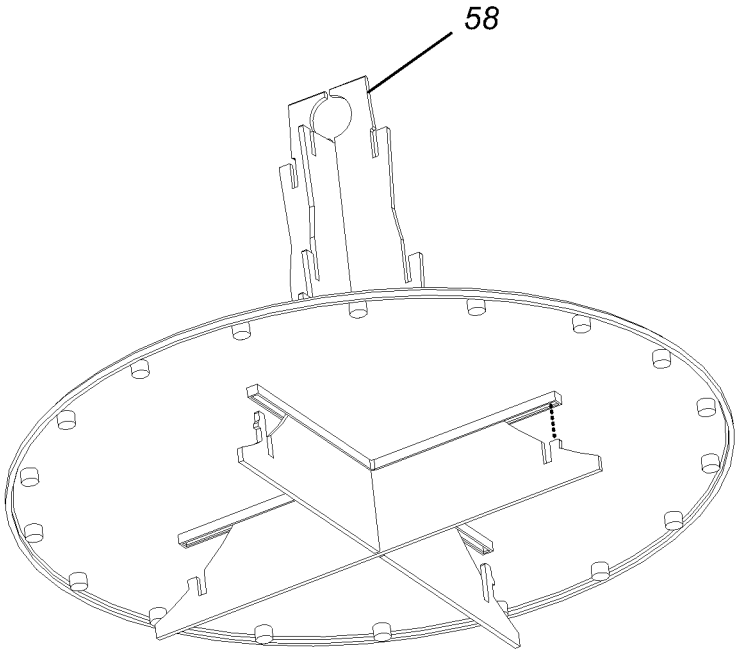
FIG. 10 depicts a view of the vertical trunk according to an embodiment of the invention.
Figure 11:
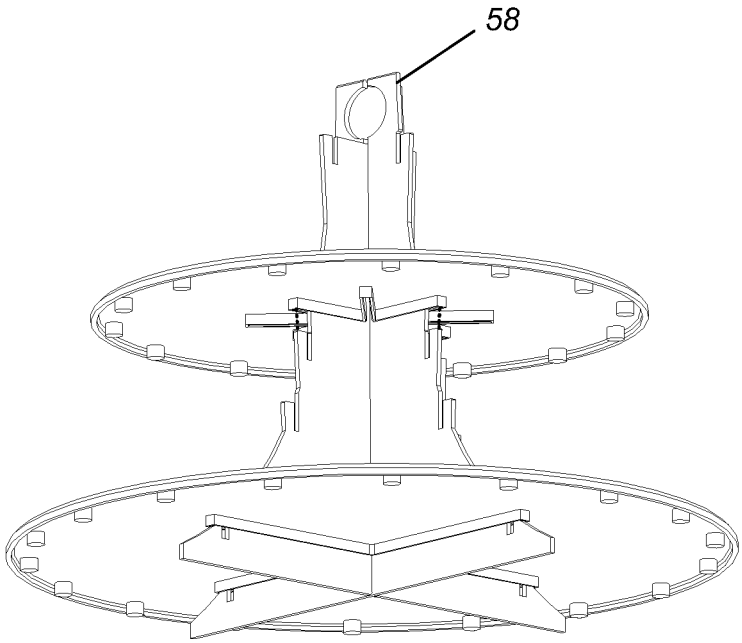
FIG. 11 depicts a view of the vertical trunk according to an embodiment of the invention.

As shown in FIGS. 10 and 11, the supports are engaged and the handle 58 allows for improved mobility of the vertical trunk and/or the display stand.

Figure 12:
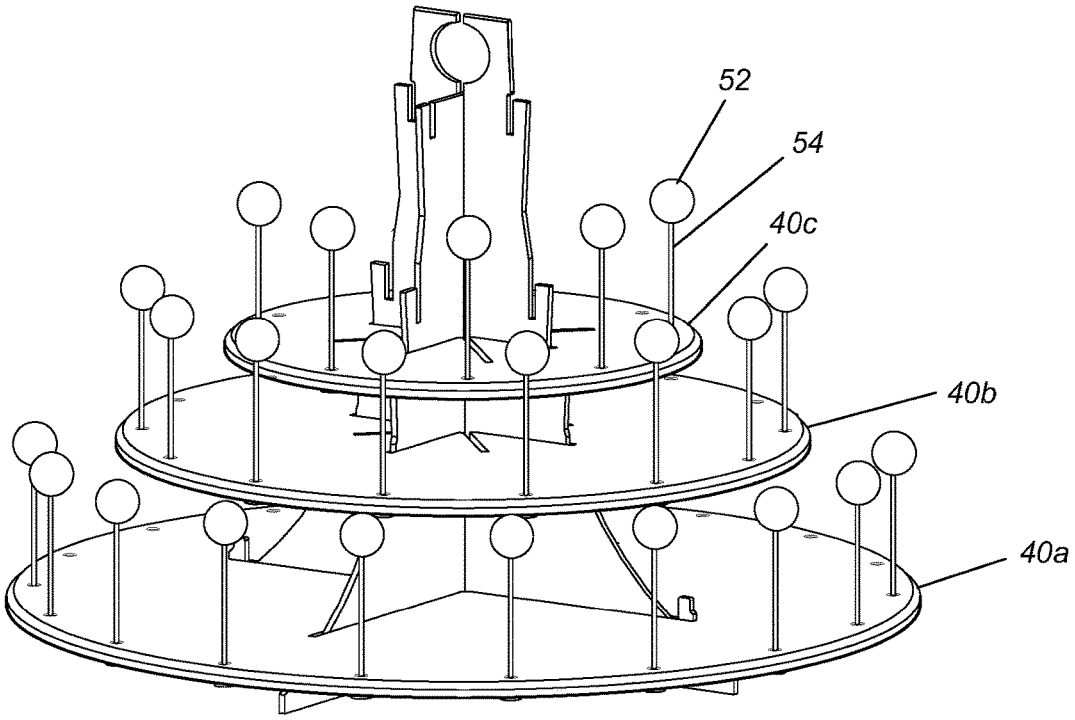
FIG. 12 depicts a view of the display according to an embodiment of the invention.

FIG. 12 shows another embodiment of the invention where the display stand is customized to accommodate different baked goods and varying amounts of baked goods by changing the heights between the platforms and the number of platforms connected to the vertical trunk. For example, in FIG. 12 the distances between the platforms and the number of platforms connected to the vertical trunk are changed allowing a user to display different types of baked goods by varying platform positions on the vertical trunk. Specifically, the platforms can be adjusted so that the height y.sub.2 between platforms 40*a* and 40*b* can be decreased by positioning each platform on its lowest connection point on the vertical trunk. The distance between the platforms can also be increased by adjusting the positioning of each connection point to a higher location on the vertical trunk. In an example, platform 40*a* is a vertical distance from 40*b* such that the baked goods displayed on each platform are easily visible and do not interfere with adjacent baked goods. As shown in FIG. 12, the platforms are positioned to accommodate cake pops. Additionally, the diameter of the platforms can vary. For example, platform 50*b* is smaller than the platform 50*a*. In an embodiment, the platform can have a diameter of 12 inches, 8 inches, 6 inches, 3 inches or 2 inches.

Figure 13:
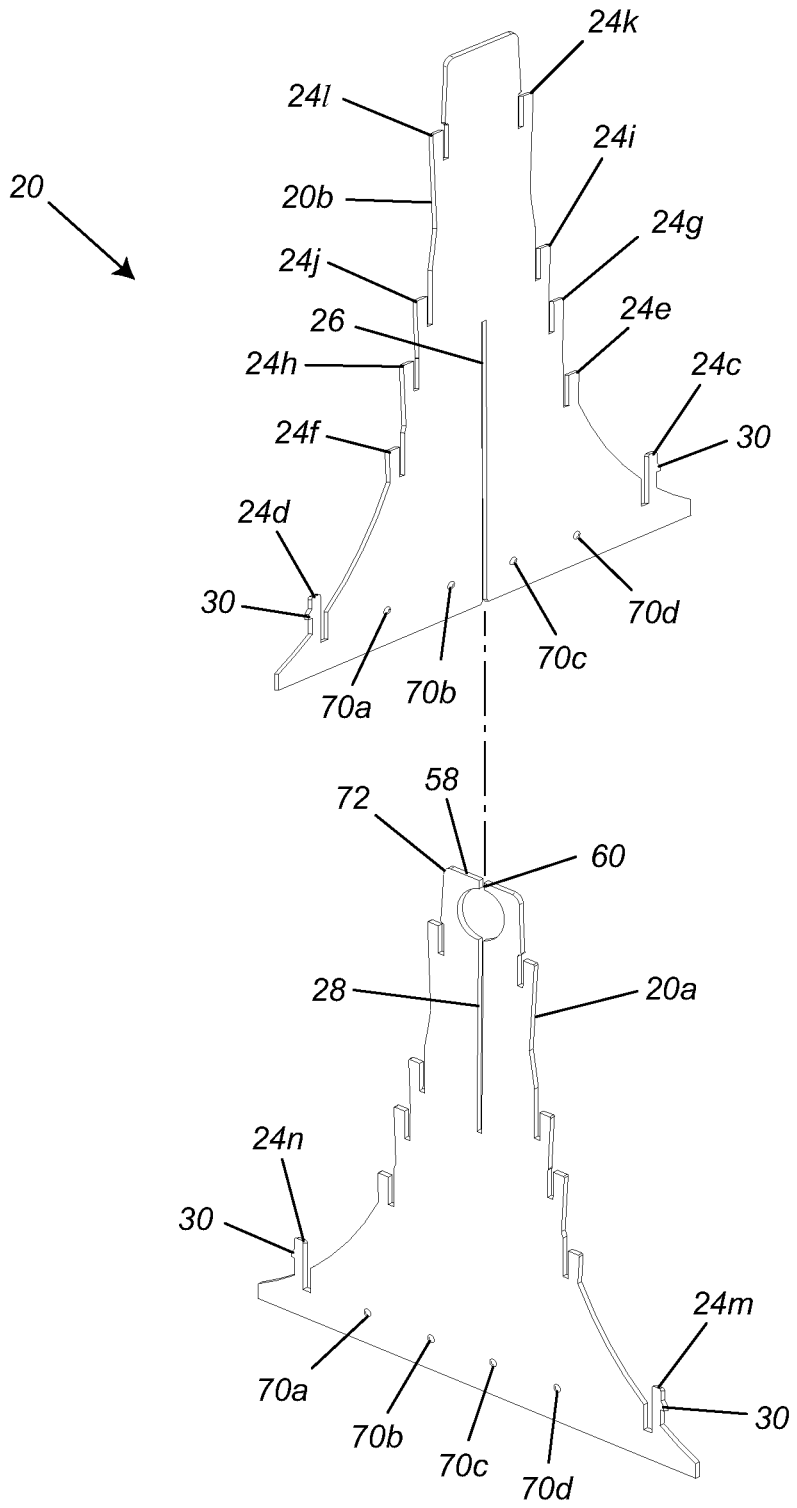
FIG. 13 depicts a view of the display according to an embodiment of the invention.

FIG. 13 is an exploded view of an embodiment of the vertical trunk 20 that includes a first support 20*a* and second support 20*b*. Planes that bisect each support may intersect to define a horizontal axis 30 and a longitudinal axis 32 about which each support may be conceived to rotate uniformly about the longitudinal axis 32.

The first support 20*a* includes a narrow opening or slot 26 in a portion of the first support that is on the longitudinal axis or parallel to the longitudinal axis in a portion. The second support has a narrow opening or slot 28 in a portion of the second support 20*b* that is on the longitudinal axis or parallel to the longitudinal axis that corresponds to the slot 26 on the first support. When assembled, the first and second supports are oriented such that first slot 26 and the second slot 28 align with respect to each other and engage to form a vertical trunk 20 with an x-shaped base. The construction of the supports may be such that the supports can be easily connected and disconnected in order to allow for a display that can be easily assembled or disassembled for compact storage.

Further, as shown in FIG. 13, each support may have one or more mounts 24*c*; 24*d*; 24*e*; 24*f*; 24*g*; 24*h*; 24*i*; 24*j*; 24*k* & 24*l* located at different positions along the longitudinal axis of the support of each vertical support. Each mount is of a shape and dimension sufficient to receive at least a portion of one groove in the platform. A support can include two mounts 24*c* and 24*d* that face each other to form a pair. The support can include one or more pairs of mounts, as shown by 24*e* & 24*f*; 24*g* & 24*h*; 24*i* & 24*j* and 24*k* & 24*l*. In an example, these pairs are also located on the second support.

Further, in an embodiment a securing mechanism 30 is provided on the mount, which can be used to provide additional security and rigidity when the platform is connected to the vertical trunk. In an example, the securing mechanism 30 is provided on the mounts 24*d* and 24*c* and the mounts 24*m* and 24*n*. In another example, securing mechanism 30 can be provided on all of the mounts on the first vertical support, all of the mounts on the second vertical support or all of the mounts on both vertical supports. Additionally, the securing mechanism can be provided in varying combinations on the mounts, e.g. only the lowermost mounts 24*d* and 24*c* and 24*f* and 24*e*. In this embodiment, the securing mechanism is a tab integrally molded as part of the support. The tab has sufficient flexibility to enable the tab to clear the edge of the groove of a platform allowing the platform to snap into place. The securing mechanism can also take the form of a slide-on clip with a projecting top design having an interlocking edge that is received within the groove of the platform. The groove may have a small ledge around all or a portion of its periphery to cause the securing mechanism to slide into place therein. Clips, snap-on clips and other securing mechanisms known to those of ordinary skill in the art can also be used to connect and disconnect the platform to the vertical trunk.

In an embodiment, additional support mechanism are provided on the lower portion of each support. As shown in FIG. 13, these support mechanisms 70(*a-d*) are protrusions that extend out horizontally from the surface of the support. In an example, the protrusions are on a first side of the first support. In an example, the protrusions are on the first and second side of the first support. In an example, the protrusions are on the first side of the second support. In an example the protrusions are on the first and second side of the second support. In an example the protrusions are on the first and second sides of both supports. In operation, when a platform is positioned above these support mechanisms, a portion of the lower surface of the platform rests on these protrusions, which provides additional support to the platform.

In an embodiment, the second support includes a handle 58 configured to allow a user to grasp the handle and transport the vertical trunk from one location to another. The handle has a narrow opening or a third slot 60 in a portion of the handle 58 that is on the longitudinal axis or parallel to the longitudinal axis that corresponds to the slot 26 on the first support. In an embodiment the top edges of the handle 72 are rounded. In another embodiment, the top edges of the handle form a right angle or an angle that is substantially 90 degrees (as shown in FIG. 9). It is understood that the shape of the handle can easily be modified according to other known shapes known to persons of ordinary skill in the art.

As can be understood by the embodiments displayed in the Figures, the display stand is highly customizable. A person of ordinary skill in the art would understand that a kit could be created with one or more platforms of the same or varying sizes with grooves that allow the platforms to connected to the vertical trunk at different positions, based on the selected grooves aligned with the underlying mounts on the vertical trunk. The different grooves in the platform allow the distance between the platforms to be customized to accommodate different sized baked goods and different amounts of baked goods. Further, the number of platforms connected to the vertical trunk can be increased or decreased based on the number of platforms a user selects to connect or disconnect to the vertical trunk, allowing for more or less baked goods to be displayed. Additionally, the openings on one or more platforms provide the option of displaying cake pops or other baked good item that utilizes a stick.

While various embodiments of the present invention have been described, it will be apparent to those of skill in the art that many more embodiments and implementations are possible that are within the scope of this invention. Accordingly, the present invention is not to be restricted except in light of the attached claims and their equivalents.

The invention claimed is:

1. A food item display system comprising:

a vertical trunk comprising a first support including a first slot in a lower portion of the first support, and a second support including a second slot in an upper portion of the second support, the first support and the second support are oriented such that the first slot and the second slot align with respect to each other and engage to form the vertical trunk, the vertical trunk including one or mounts extending substantially vertically along a vertical length of the vertical trunk;

at least one platform comprising an upper surface opposing a lower surface, the at least one platform including a first groove and a second groove to define a first pair of grooves, and a third groove and a fourth groove to define a second pair of grooves configured to connect the at least one platform to the vertical trunk and disconnect the at least one platform from the vertical trunk, the first groove and the second groove have the same corresponding dimensions to collectively define a first x-shaped opening that can be rotated uniformly about a longitudinal axis by rotation of the at least one platform, and the third groove and the fourth groove have the same corresponding dimensions to collectively define a second x-shaped opening that can be rotated uniformly about a longitudinal axis by rotation of the at least one platform such that the at least one platform can be mounted onto the vertical trunk through the first x-shaped opening or the second x-shaped opening;

wherein the length of each of the first groove and the second groove differs from the length of each of the third groove and the fourth groove, such that the vertical location where the at least one platform is attached to the vertical trunk can be changed by rotating the at least one platform such that the first pair of grooves or the second pair of grooves align with the one or more mounts on the vertical trunk.

2. The food item display system according to claim 1, wherein the at least one platform is slidably inserted on the vertical trunk.

3. The food item display system according to claim 1, wherein the first slot and the second slot engage with each other to form an x-shaped base.

4. The food item display system according to claim 1, wherein the at least one platform includes an opening configured to receive an item therein on the upper surface.

5. The food item display system according to claim 1, wherein the first support and the second support each have a pair of mounts of said one or more mounts located at a point along a longitudinal axis of the vertical trunk, each mount of the pair of mounts of each of the first support and the second support is of a shape and dimension sufficient to receive at least a portion of one of the first groove or the second groove.

6. The food item display system according to claim 1, wherein the first support and the second support can disengage from each other.

7. The food item display system according to claim 1, wherein the first pair of grooves is configured such that one or more of the depth and width of the first pair of grooves differ from one or more of the depth and width of the second pair of grooves.

8. The food item display system according to claim 5, wherein each of the mounts of the pair of mounts of each of the first support and the second support includes a securing mechanism.

9. The food item display system according to claim 1, wherein the at least one platform supports a food item as the vertical trunk supports the at least one platform.

10. The food item display system according to claim 1, wherein the at least one platform includes a first platform and a second platform of same shapes by different sizes.

11. The food item display system according to claim 1, wherein the at least one platform includes a first platform and a second platform, the first platform mounts lower on the vertical trunk than the second platform, the first platform and the second platform having openings of different perimeters.

12. A kit for displaying a food item, the kit comprising:

a first support including a first slot in a lower portion of the first support;

a second support including a second slot in an upper portion of the second support, the first support and the second support are oriented such that the first slot and the second slot align with respect to each other to engage and disengage with each other, the first support and the second support including one or more mounts extending substantially vertically along a vertical length of the respective first support and second support;

a first platform comprising an upper surface opposing a lower surface, the first platform including a first groove and a second groove to define a single-x-shaped opening such that the first platform can be mounted onto the first support and the second support through the single-x-shaped opening;

a second platform comprising an upper surface opposing a lower surface, the second platform including a first groove and a second groove to define a first pair of grooves, and a third groove and a fourth groove to define a second pair of grooves configured to connect and disconnect the second platform to the first support and the second support, the first groove and the second groove of the second platform have the same corresponding dimensions to collectively define a first x-shaped opening that can be rotated uniformly about a longitudinal axis by rotation of the second platform, and the third groove and the fourth groove have the same corresponding dimensions to collectively define a second x-shaped opening that can be conceived to rotate uniformly about a longitudinal axis by rotation of the second platform, the first x-shaped opening and the second x-shaped opening collectively defining a double-x-shaped opening such that the second platform can be mounted onto the first support and the second support through the first x-shaped opening or the second x-shaped opening;

wherein the length of each of the first groove and the second groove of the second platform differs from the length of each of the third groove and the fourth groove of the second platform, such that the vertical location where the second platform is attached to the first support and the second support can be changed by rotating the second platform such that the first pair of grooves or the second pair of grooves align with the one or more mounts on the first support and the second support.

13. The kit of claim 12, wherein the first platform includes a first perimeter and the second platform includes a second perimeter, the first perimeter is bigger than the second perimeter.

14. The kit of claim 12, wherein the first platform mounts lower on the vertical trunk than the second platform.

* * * * *